US005762130A

United States Patent [19]

Uibel et al.

[11] Patent Number: 5,762,130

[45] Date of Patent: Jun. 9, 1998

[54] DOWN FLOW, TWO PASS RADIATOR WITH AIR VENTING MEANS

[75] Inventors: Jeff Ross Uibel, Lockport; Colin Van Tuyl Johnson, Snyder; Joel Thomas Hambruch, Burt, all of N.Y.

[73] Assignee: General Motors Corporation, Detroit, Mich.

[21] Appl. No.: 762,476

[22] Filed: Dec. 9, 1996

[51] Int. Cl.[6] ..... F01P 11/02

[52] U.S. Cl. ..... 165/71; 165/104.32; 165/174; 123/41.54

[58] Field of Search ..... 165/71, 104.32, 165/174, 176, 103; 123/41.54

[56] References Cited

U.S. PATENT DOCUMENTS

| | | | |
|---|---|---|---|
| 1,840,575 | 1/1932 | Flower | 165/71 |
| 2,004,390 | 6/1935 | Benzinger | 165/71 |
| 4,098,328 | 7/1978 | Cheong | 165/107 |
| 4,199,332 | 4/1980 | Krohn et al. | 55/191 |
| 4,422,502 | 12/1983 | Villeval | 165/104.32 |
| 4,747,446 | 5/1988 | Polidori et al. | 165/104.32 |
| 4,790,369 | 12/1988 | Avrea | 165/104.32 |
| 5,135,049 | 8/1992 | Attinger et al. | 165/104.32 |
| 5,329,889 | 7/1994 | Caldwell | 123/41.54 |
| 5,385,123 | 1/1995 | Evans | 123/41.21 |

*Primary Examiner*—Allen J. Flanigan
*Attorney, Agent, or Firm*—Patrick M. Griffin

[57] ABSTRACT

A down flow, two pass radiator includes a means for selectively venting air displaced during coolant fill from one side of the top tank flow baffle to the other, while the baffle remains fluid tight during normal operation. The uppermost wall of the top tank slopes continually upwardly from the far, low end of the tank to a filler neck at the opposite, high end. A vent inlet through the baffle, near the inner surface of the uppermost wall, may be covered and uncovered by a blocking valve accessible from outside the top tank. The valve is left closed during normal radiator operation, but opened during coolant fill to allow free escape of displaced air across the baffle and out through the open filler neck.

3 Claims, 2 Drawing Sheets

DOWN FLOW, TWO PASS RADIATOR WITH AIR VENTING MEANS

TECHNICAL FIELD

This invention relates to down flow, two pass radiators in general, and specifically to such a radiator with a special provision to allow selective venting of air between multiple divided sections of the top tank during radiator fill.

BACKGROUND OF THE INVENTION

Vehicle radiators have two manifold tanks that interconnect a plurality of generally parallel flow tubes, feeding coolant through the tubes in one or several passes. In the case of multi pass flow, the interiors of one or more of the tanks contain solid baffles which divide the tanks up into two or more sections, thereby dividing the flow tubes up into two or more passes. Radiators may also be mounted in a cross flow or down flow orientation. In a cross flow orientation, the tanks are generally vertical, one on either side of the radiator, with horizontal flow tubes. A down flow radiator is turned ninety degrees, with one tank horizontal at the top, one horizontal at the bottom, and generally vertical flow tubes. With either orientation, a removably capped filler neck opens through one end of one tank (either a side tank or a top tank) to allow the radiator to be filled with coolant. Fluid fill is infrequent, occurring either during vehicle assembly or later, during vehicle service. In either case, the coolant displaces air in the radiator, which needs to be vented to assure a solid and complete fluid fill. In a single pass radiator, with no baffles dividing up the interior of the tank, air bubbles in the fluid will naturally float and flow upward without interference toward the highest open point in the radiator, which is the open filler neck, where they can ultimately vent to atmosphere. With a multi pass design however, especially a two pass radiator with a down flow orientation, a unique venting problem is presented. A flow dividing baffle divides the center of the top tank into two sections, a first section opposite the filler neck, to which the filler neck cannot directly open, and a second section into which the filler neck does open. During coolant fill, air floating upwardly into the top tank's first section will be blocked by the baffle from reaching the second section or the open filler neck, which would jeopardize an adequate fluid fill.

SUMMARY OF THE INVENTION

The invention provides a down flow, two pass radiator with a selective venting means that allows air to vent between the two sections of the top tank during fill, but which maintains the fluid seal integrity of both the baffle and the top tank during normal radiator operation.

In the preferred embodiment disclosed, the top tank is a plastic molding with an uppermost wall that slopes contiguously upwardly from the far end of the top tank all the way to the filler neck. The flow division baffle sits at the approximate center of the top tank, dividing it into a first section blocked off from the filler neck and a second section that can be opened to atmosphere, through the filler neck. On one side of the baffle, within the second tank section, a sleeve shaped valve housing molded integrally into the tank sits adjacent the baffle. A vent inlet opens from the first section of the top tank, through the baffle, and into the main body of the adjacent valve housing. A radially opposed and axially offset vent outlet opens from the main body of the valve housing, into the second section of the top tank. A blocking valve in the form of a plug threaded into the sleeve is movable back and forth, accessible from outside the top tank through an open end of the sleeve. The valve carries a pair of O rings tightly engaged within the sleeve.

When the plug is threaded fully into the sleeve in a closed position, during normal radiator operation, the O rings border the vent inlet and block it from the vent outlet. This maintains the fluid sealing integrity of the baffle. During radiator fill, the plug is backed out, moving the vent inlet outside the O rings and interconnecting it with the vent outlet. Air rising into the top tank's first section can then float along the inner surface of the upwardly sloping uppermost wall, through the interconnected vent inlet and outlet, and finally to the open filler neck and out to atmosphere. The continual threaded engagement of the plug with the interior of the sleeve prevents fluid loss from the top tank.

BRIEF DESCRIPTION OF THE DRAWINGS

These and other features of the invention will appear from the following written description, and from the drawings, in which.

DESCRIPTION OF THE PREFERRED EMBODIMENT

Figure 1:
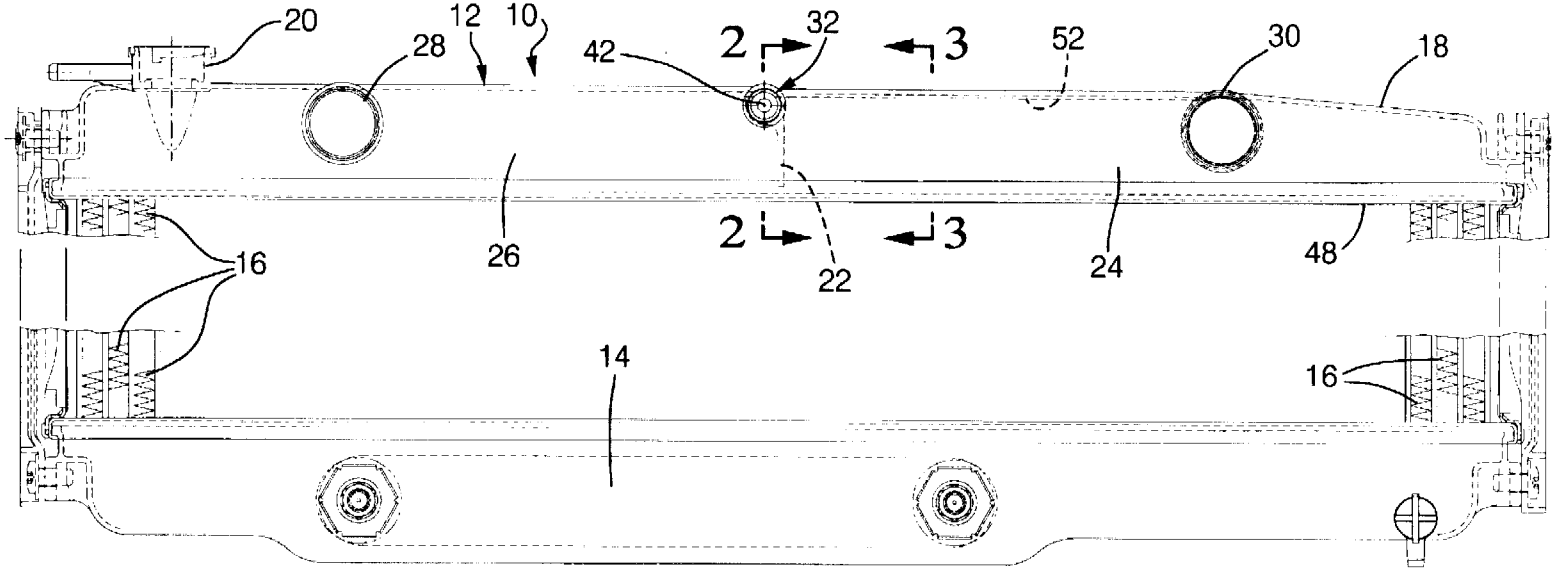
FIG. 1 is a front view of a down flow radiator incorporating a preferred embodiment of the venting means of the invention.

Referring first to FIG. 1, a down flow vehicle radiator incorporating the venting means of the invention is indicated generally at 10. Radiator 10 has a horizontal top tank, indicated generally at 12, a horizontal bottom tank 14, and a plurality of vertical flow tubes 16 extending therebetween. Each tank 12 and 14 is a molded plastic box, and the top tank 12 has several structural features molded integrally to it. Most significantly, top tank 12 has an uppermost wall 18 which, rather than being horizontal and flat slopes gradually and continually upwardly from a low end to a high end. Molded through uppermost wall 18 at the high end of top tank 12 is a fill opening in the form of a conventional filler neck 20, which is closed and opened by a conventional filler cap, not illustrated. The filler cap remains closed during normal operation of radiator 10, that is, during vehicle operation, and can incorporate a pressure controlled release valve for vapor or air that is generated during normal operation. That is not the thrust of the invention, however. Rather, it is displaced air that must be vented during coolant fill from top tank 12. During fill, of course, the filler neck 20 is open to atmosphere, and, since it is at a highest point, displaced air will vent freely therefrom, if it can reach it. In radiator 10, however, there is an impediment to such free venting. Near the center of top tank 12, an integrally molded baffle 22 divides it into a first section 24, blocked off from the filler neck 20, and a second section 26, into which the filler neck 20 opens. A coolant inlet 28 protruding from the front of the second top tank section 26 receives coolant from the vehicle engine which, being blocked by the baffle 22, can feed into and flow down through only approximately half of the flow tubes 16, into the bottom tank 14. From there, coolant flows back up the other half of the flow tubes 16 in a U pattern, into the first top tank section 24, and ultimately out of a coolant outlet 30 and back to the engine. This is a so called two pass flow pattern which, while relatively rare in production, can offer improved thermal performance in certain applications. The drawback occurs during fluid fill, when any air being displaced up the flow tubes 16 and into the first top tank section 24 would be blocked by the barrier of the baffle 22, the thereby prevented from venting freely out of the open filler neck 20. This could jeopardize a complete, solid liquid fill.

Figure 2:
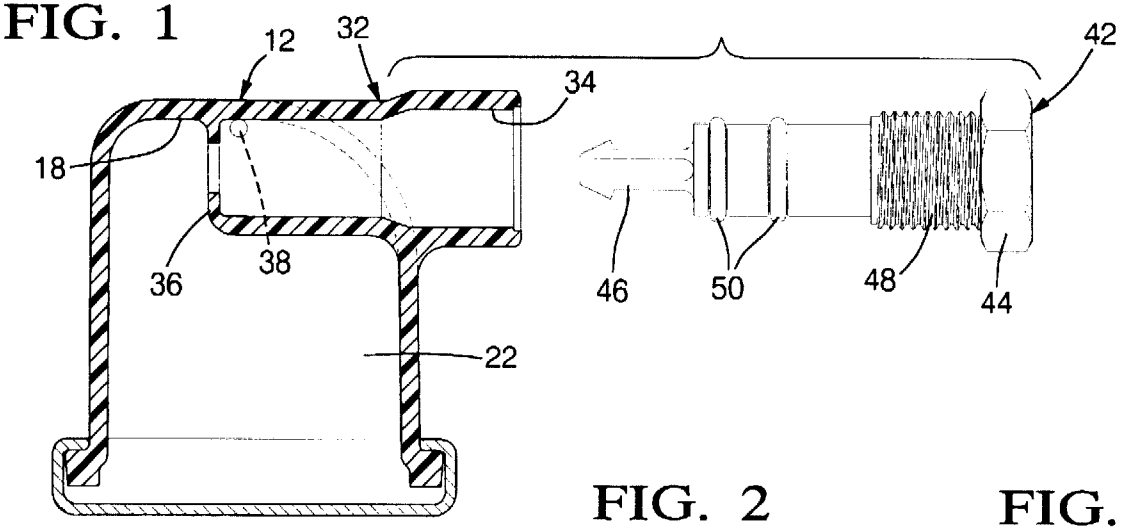
FIG. 2 is a cross sectional view of the top tank taken along the line 2—2 of FIG. 1, showing the blocking valve removed.
Figure 3:
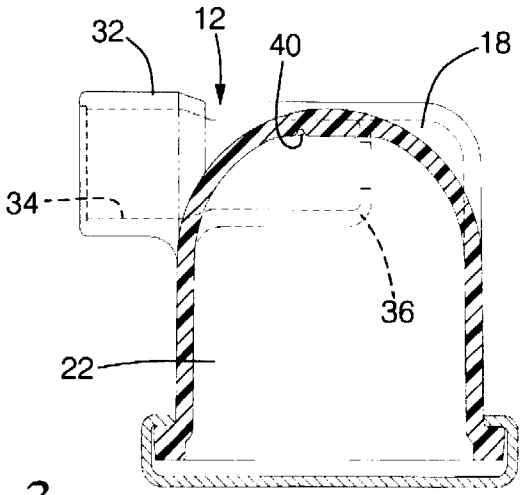
FIG. 3 is a cross sectional view of the top tank taken along the line 3—3 of FIG. 1.

Referring next to FIGS. 2 and 3, the invention provides a means to allow free air venting from tank section 24 to tank section 26 during fluid fill, but without affecting the operation of the flow dividing baffle 22 at other times. Molded into top tank 12 second section 26, integral with and parallel to baffle 22, is a generally cylindrical or sleeve shaped valve housing, indicated generally at 32. The interior of valve housing 32 has a constant diameter, except for a widened throat 34 that protrudes from the front of top tank 12. Housing 32 extends from throat 34 into and about two thirds of the way across the width of top tank 12, to an apertured end wall 36. As best seen in FIG. 2, a vent outlet 38 opens through one side of housing 32, into the top tank second section 26, at a point near the housing end wall 36. The vent outlet 38 is located as near to the highest point of top tank uppermost wall 18 as possible. As best seen in FIG. 3, a radially opposed vent inlet 40 opens through the other side of housing 32, that is, through the integral baffle 22, and into the top tank first section 24. The vent inlet 40 is axially displaced from the vent outlet 38, being located farther from the housing end wall 36. A blocking valve in the form of a solid plastic plug, indicated generally at 42, has a hex head 44 at the front and a pair of barbed flexible fingers 46 at the end. The body of plug 42 includes a wider, threaded collar 48 just behind the head 44, and a pair of axially spaced, elastomer O rings 50 just in front of the barbed fingers 46. The threaded collar 48 threads closely within the inner surface of the housing throat 34. The O rings 50 fit tightly enough within the interior of housing 32 to provide a fluid seal, but not so tightly as to prevent the plug 42 from being threaded axially back and forth. When plug 42 is initially inserted axially into housing 32, the barbed fingers 46 snap through the apertured housing end wall 36, for a purpose described below. Finally, in the embodiment disclosed, the inner surface of the top tank uppermost wall 18 is molded with an inset groove 52, near the center, that runs all the way from the low end of the first top tank section 24 up to the vent inlet 40. In the embodiment disclosed, a thick ridge of plastic material 54 is molded to the inner surface of uppermost wall 18, to serve as a material runner during the injection molding process. Groove 52 sits beside the ridge 54.

Figure 4:
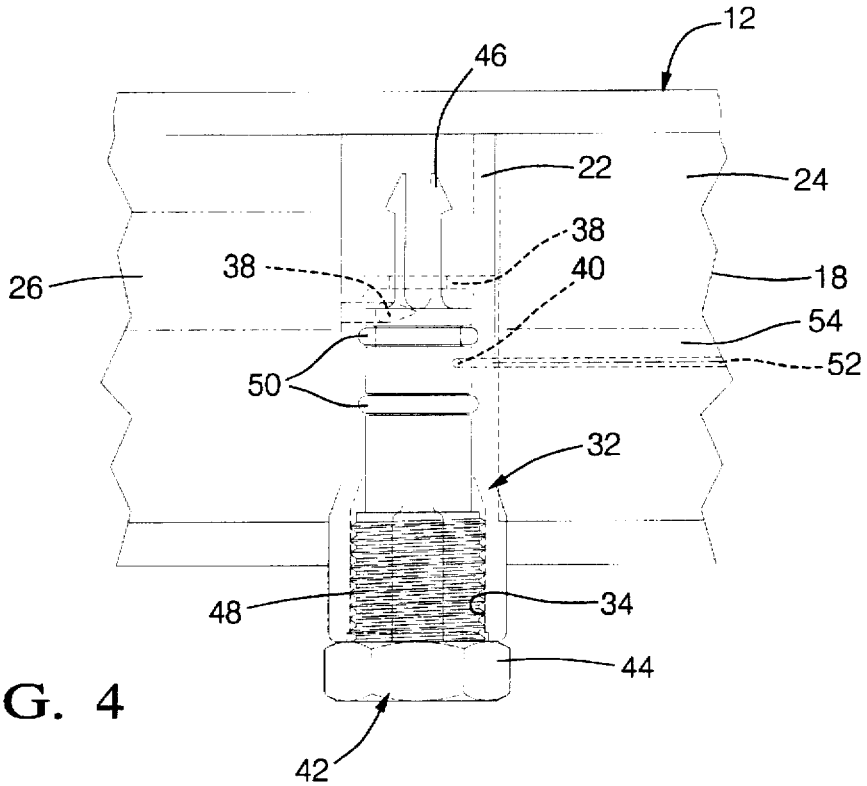
FIG. 4 is plan view of a section of the uppermost wall of the tank and the valve housing, showing the valve in a closed position.
Figure 5:
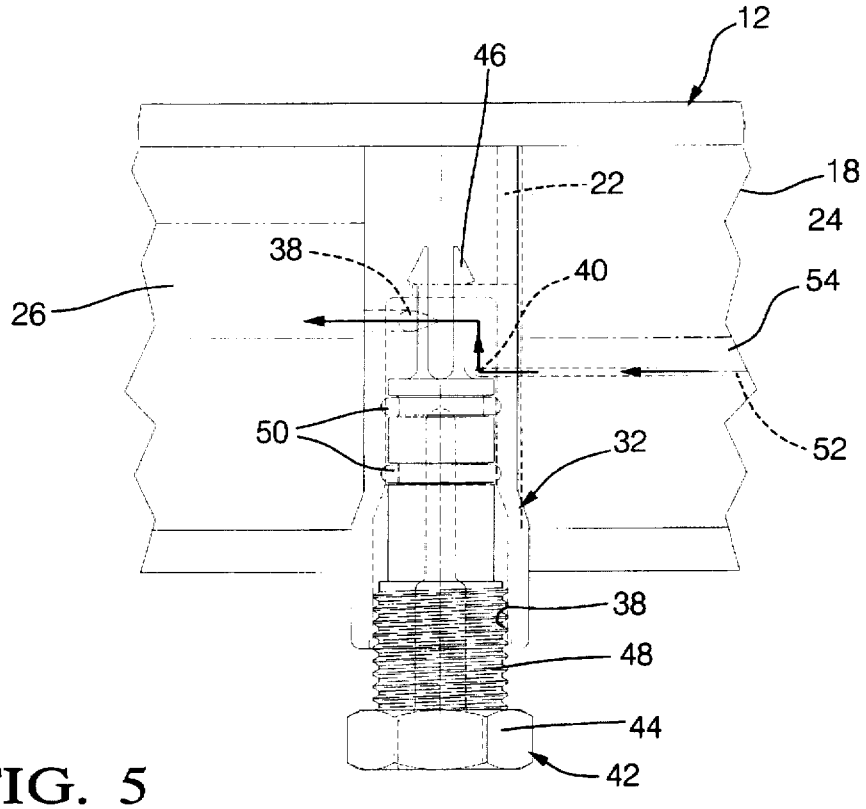
FIG. 5 is a view like FIG. 4, showing the blocking valve in an open position.

Referring next to FIGS. 4 and 5, the operation of the venting means of the invention is illustrated. During normal operation of radiator 10, plug 42 is threaded all the way into valve housing 32, as illustrated in FIG. 4. The O rings 50 bracket and border the vent inlet 40, thereby blocking any connection between the vent inlet 40 and vent outlet 38, and preventing any coolant flow through baffle 22. Therefore, the integrity of baffle 22 is maintained, and there is no disruption of the two pass flow created by baffle 22. When it is desired to fill or refill radiator 10, the filler neck 20 is uncapped and the plug 42 is backed out of the valve housing 32 with a suitable wrench applied to hex head 44. The barbed fingers 46 engage the apertured housing end wall 36 to prevent plug 42 from being backed out too far, and the threaded collar 48 remains threaded within the valve housing throat 34. Concurrently, both of the O rings 50 move past the vent inlet 40, allowing it to interconnect with the vent outlet 38. As the radiator 10 is filled through filler neck 20, coolant runs down the tubes 16 and into the bottom tank 14. Air is displaced upwardly, into both top tank sections 24 and 26. Air entering the tank section 26 can freely vent out of the open filler neck 20, of course, assisted by floating along and up the gradually sloping uppermost wall 18. Air will enter the other top tank section 24, as well, since about half of the flow tubes 16 open into it. Air from the top tank section 24 can also float along the inner surface of the uppermost top tank wall 18, flowing in the channel provided by the inset groove 52. Eventually, air from the first tank section 24 passes through the interconnected vent inlet 40 and outlet 38, thereby passing through the baffle 22, into the top tank section 26, and ultimately out through the open filler neck 20. Although the housing end wall 38 is apertured, providing what would appear to be a potential air path, as well, the vent inlet 40 is important because of its location close to the highest point of uppermost wall 18. Venting air will tend to float to such a high point. As air vents, both the O rings 50 and the continued threaded engagement of the collar 48 with the interior of the valve housing 32 prevent the loss of any coolant out through the housing throat 34. The plug 40 is threaded back to the closed position when fill is completed.

Variations in the disclosed embodiment could be made. Most basically, a baffle with a single vent opening, selectively covered and uncovered by any movable blocking valve accessible from outside of the top tank, could serve to interconnect or block the two top tank sections from one another. A valve housing located beside the baffle, with a vent outlet that can be selectively interconnected with, or blocked from, the baffle's vent inlet, by a valve movable within the housing, is a convenient means for making and breaking the vent path, however. Furthermore, a cylindrical valve housing like 32, combined with a threaded, axially movable plug like 42 is a simple and advantageous form for the housing and valve. A different means for selectively moving the plug 42 within the housing 32, other than the threaded collar 48, could be provided. For example, a spring loaded, bayonet type quarter turn, slot and pin arrangement could be used. The barbed fingers 46 are not necessary just to allow the plug 42 to move back and forth, but are very useful to prevent inadvertent removal of the plug 42 and consequent temporary coolant loss. The inset groove 52 is not absolutely necessary to guide air flow out of the first tank section 24, so long as the vent inlet through the baffle is located at a high point. While one valve used with two upper tank sections is shown, two valves combined with three tank sections, of three with four, etc., could be used if more than two passes were desired. Therefore, it will be understood that it is not intended to limit the invention to just the embodiment disclosed.

We claim:

1. In a vehicle radiator of the down flow type having generally horizontally oriented top and bottom tanks with a plurality of generally vertically oriented flow tubes extending between said tanks through which fluid flows during normal operation, said top tank having a normally closed fill opening near one end that can be opened to fill said heat exchanger with fluid when said radiator is not operating, said fluid displacing air into said top tank during fill, said top tank also being divided by a baffle into a first section separated from said fill opening and a second section containing said fill opening, so as to divide said flow tubes into first and second flow passes, the improvement comprising a means for selectively venting displaced air from the first to the second section of said top tank during fluid fill, comprising, an uppermost wall in said top tank that slopes continuously upwardly from the end of said top tank first section to said fill opening, said baffle further having a vent inlet opening therethrough from said top tank first section and into said top tank second section, and, a blocking valve selectively movable from a normally closed position sealing and covering said vent inlet to an open position uncovering said vent inlet, whereby, during normal radiator operation, said blocking valve remains closed, maintaining the flow division created by said baffle, and when said radiator is being filled, said blocking valve may be opened to allow air from the first section of said top tank to float along said uppermost wall from said top tank first section wall, to said baffle and through said vent inlet and into said top tank second section to continue along said uppermost wall to said fill opening.

2. In a vehicle radiator of the down flow type having generally horizontally oriented top and bottom tanks with a plurality of generally vertically oriented flow tubes extending between said tanks through which fluid flows during normal operation, said top tank having a normally closed fill opening near one end that can be opened to fill said heat exchanger with fluid when said radiator is not operating, said fluid displacing air into said top tank during fill, said top tank also being divided by a baffle into a first section separated from said fill opening and a second section containing said fill opening, so as to divide said flow tubes into first and second flow passes, the improvement comprising a means for selectively venting displaced air from the first to the second section of said top tank during fluid fill, comprising, an uppermost wall in said top tank that slopes continuously upwardly from the end of said top tank first section to said fill opening, a valve housing located in said top tank second section beside said baffle and having a vent outlet opening into said top tank second section, said baffle further having a vent inlet opening from said top tank first section and into said valve housing, and, a blocking valve selectively movable within said housing from a normally closed position blocking said vent inlet and outlet from one another to an open position interconnecting said vent inlet and outlet, whereby, during normal radiator operation, said blocking valve remains closed, maintaining the flow division created by said baffle, and when said radiator is being filled, said blocking valve may be opened to allow air from the first section of said top tank to float along said uppermost wall from said top tank first section wall, to said baffle and through said interconnected vent inlet and outlet into said top tank second section to continue along said uppermost wall to said fill opening.

3. In a vehicle radiator of the down flow type having generally horizontally oriented top and bottom tanks with a plurality of generally vertically oriented flow tubes extending between said tanks through which fluid flows during normal operation, said top tank having a normally closed fill opening near one end that can be opened to fill said heat exchanger with fluid when said radiator is not operating, said fluid displacing air into said top tank during fill, said top tank also being divided by a baffle into a first section separated from said fill opening and a second section containing said fill opening, so as to divide said flow tubes into first and second flow passes, the improvement comprising a means for selectively venting displaced air from the first to the second section of said top tank during fluid fill, comprising, an uppermost wall in said top tank that slopes continuously upwardly from the end of said top tank first section to said fill opening, a cylindrical valve housing located in said top tank second section and integral to said baffle and having a vent outlet opening into said top tank second section, said baffle further having a vent inlet opening from said top tank first section and into said valve housing, and, a threaded plug axially movable within said housing from a normally closed inward position blocking said vent inlet and outlet from one another to an outward position interconnecting said vent inlet and outlet, whereby, during normal radiator operation, said plug remains threaded inward, maintaining the flow division created by said baffle, and when said radiator is being filled, said plug may be threaded outwardly to allow air from the first section of said top tank to float along said uppermost wall from said top tank first section wall, to said baffle and through said interconnected vent inlet and outlet into said top tank second section to continue along said uppermost wall to said fill opening.

* * * * *